US005505333A

United States Patent [19]

Shibazaki et al.

[11] Patent Number: 5,505,333

[45] Date of Patent: Apr. 9, 1996

[54] CARD VENDING MACHINE

[75] Inventors: Makoto Shibazaki; Takao Tsuchida, both of Tokyo, Japan

[73] Assignee: Bandai Co. Ltd., Japan

[21] Appl. No.: 291,777

[22] Filed: Aug. 17, 1994

[51] Int. Cl.[6] ..... G07F 11/00

[52] U.S. Cl. ..... 221/155; 221/24; 221/197

[58] Field of Search ..... 221/155, 24, 197

[56] References Cited

U.S. PATENT DOCUMENTS 3,036,732 5/1962 Schaeff ..... 221/155

3,536,231 10/1970 Knickerbocker ..... 221/155

*Primary Examiner*—William E. Terrell
*Assistant Examiner*—Tamara Kelly
*Attorney, Agent, or Firm*—Graham & James

[57] ABSTRACT

A vending machine for selling card-like articles having a coin insert located off-center in the front of the vending machine and a handle for advancing card-like article for output. An output maybe provided on the front side of the vending machine. A display panel is provided for showing a display having a depiction or description of the card-like article. Optionally a ceiling cover may be provide which can be slid back for removal and insertion of the display in the vending machine.

8 Claims, 6 Drawing Sheets

CARD VENDING MACHINE

BACKGROUND OF THE INVENTION

1. Field of Invention

The present invention relates to a manual type card vending machine which dispenses a card upon insertion of a predetermined amount of coin or coins.

2. Description of Prior Art Technology

In recent years, cards displaying popular characters have been popular amongst children for collection. Various types of manual type card vending machines have been developed for selling cards displaying various characters.

Prior art manual type card vending machines which sell these types of cards have been designed to have width of 260 mm; on the bottom, depth of 350 mm; and height of 670 mm. Further, a coin return opening or slot has been employed for returning a coin and a coin insertion opening or slot for inserting a coin are located in the center of the front portion of the vending machine main body, or at its edge.

When purchasing a card, after inserting a predetermined amount of coins into the coin insertion opening, a handle is turned which is provided on the side of the vending machine main body. In this way, by turning the handle provided on the side of the vending machine main body, a card is advanced to a card dispensing opening where it can be taken out.

Since the prior art manual type card vending machine has the coin insertion slot and the coin return opening on the center line of the front portion of the vending machine main body, or on the edge of the front portion of the vending machine main body, a card information display portion occupies the area excluding the area occupied by the coin insertion slot and the coin return opening. For this reason, the area of the display for card information is limited and had a problem where an area for display relating to advertisement of the card is limited.

Further, where the coin insertion slot and the coin return opening are formed at the location on the center line of the frontal portion of the vending machine main body, the card information display portion is split in the center and it was problematic in that it was difficult to do an effective advertising.

Furthermore, the vending machine of the prior art apparatus is not only large, but also had a handle for taking out a card on the side of the vending machine main body so that where a plurality of manual type card vending machines are set side-by-side, the protruding handle on the side of the vending machine main body and its adjacent manual type card vending machine necessitate a sufficient amount of space therebetween for the operation of the handle, thereby requiring a larger area for their installation.

For this redson, it is possible to consider down-sizing the vending machine main body to lessen the setting area per one vending machine, but this is accompanied by a problem of smaller card information display area which is set in the front portion of the vending machine main body.

SUMMARY OF INVENTION

One of the objects of the present invention is to provide a vending machine having a larger area for displaying card information even where the manual-type card vending machines have been downsized, and at the same time to provide a manual type card vending machine where a plurality of which can be set up side-by-side in a smaller area.

In one embodiment according to the present invention is provided with a vending machine main body and a transparent cover which covers the front portion of the vending machine main body and extends to the sides of the vending machine main body. The machine has a coin insertion portion elongated in a longitudinal direction and located off the center of the front side of the vending machine main body. It has a handle for taking out a card after inserting coins into the coin insertion portion and is provided on the front portion of the vending machine main body, and the transparent display cover has on its front side a flat part and inclining sides or interior wings which slope toward the coin insertion portion from the flat portion; and the tips of the inclining portions open to the coin insertion portion; and further-the transparent cover is provided with a container portion Which is capable of containing a card information display on its interior side from the front to the sides of the vending machine main body.

In another embodiment of the card vending machine provided by the present invention, the following provisions are made. The vending machine employs a vending machine main body and a transparent cover which extends to the vending machine main body sides and covers the vending machine main body front side, and a card information display disposed between the transparent cover and vending machine main body. It provides on the front side of the vending machine main body, a coin insertion portion which is formed elongated in the longitudinal direction at a location off of its center. A handle is employed on the front side of the vending machine main body for taking out a card after inserting coins into the coin insertion portion. The transparent cover has a flat portion on its front side and inclining portions which incline toward the coin insertion portion from the flat portion, and the tip of the sloped portion opens for the coin insertion portion, and the card information display conforms to the shape of the transparent cover, and the portion which can be viewed from the inclining portions of the transparent cover can be viewed with other portions.

The first embodiment of the vending machine according to the present invention has a coin insertion portion formed longitudinally elongated and located off the center of the front portion of the vending machine main body, and a transparent cover which covers the front of the vending machine main body and extends to the vending machine main body sides and which further has a flat portion on its front and inclining portions which slope toward the sides of the coin insertion portion from the flat portion, and the tips of the inclining portions end where the coin insertion portion is. Further, by employing a container portion which can contain a card information display on the interior of the transparent cover from the front side of the vending machine main body to the sides, and by partially wrapping the transparent cover onto the main body of the vending machine, the card information display can be fixed on the front side to the sides of the vending machine main body. Information relating to cards are displayed on the card information display which is viewed through the transparent cover, and since the portion which can be seen from the sloped portion of the transparent cover and the portion which can be seen from the sides of the vending machine main body can be viewed along with the portion which is located in the front, an area allocated for displaying card information can is greater even where the vending machine main body is downsized.

Further, since a handle for taking out a card after inserting coins into the coin insertion portion is employed on the front side of the vending machine main body, it is possible to set a plurality of manual type card vending machines side-by-side very closely, and can further reduce the size of an area required for setting the machines.

The second embodiment according to the present invention has a vending machine main body, a transparent cover which covers the front side of the vending machine main body and extends onto the sides of the vending machine main body, and a card information display which is disposed between the transparent cover and the main body of the vending machine. The coin insertion slot is employed in an elongated shape in the longitudinal direction and in a location off of the center of the front portion of the vending machine main body. The front portion of the transparent cover has a flat portion and sloped portions which slope toward the sides of the coin insertion portion from the flat portion, and the ends of the sloped portions open up where the coin insertion portion is. Further, since the card information display employed between the vending machine main body and the transparent cover is formed conforming to the shape of the transparent cover, and the portion which can be viewed from the sloped portions of the transparent cover can be viewed along with the other portion, even where the vending machine main body is down-sized, the area designated for display of the card information is larger.

Furthermore, since a handle for taking out a card after inserting coins in the coin insertion portion is disposed on the front side of the vending machine main body, this enables setting of a plurality of manual type card vending machines side-by-side and closely, thereby requiring only a very limited amount of installation space.

DETAILED DESCRIPTION OF THE INVENTION

Figure 1:
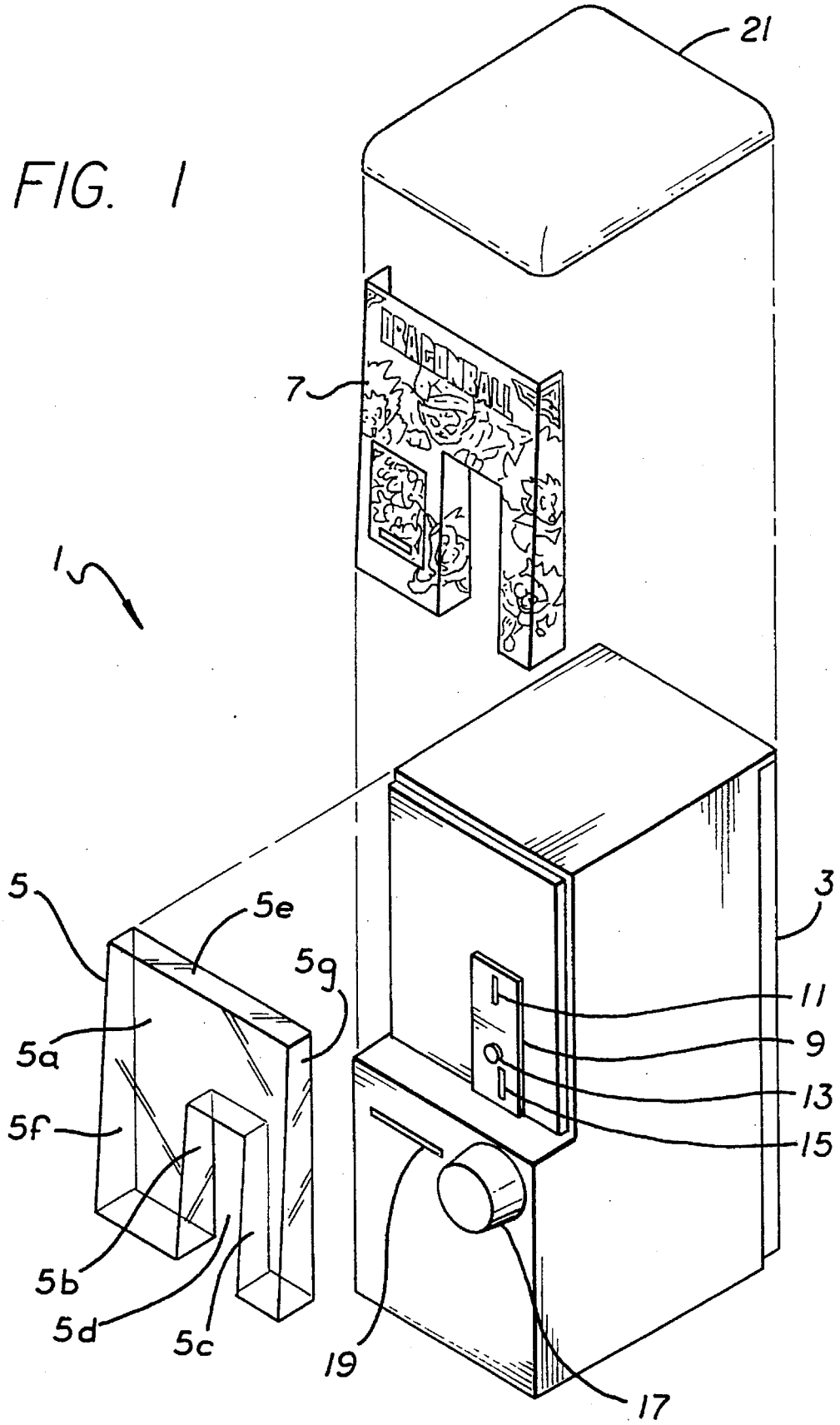
FIG. 1 shows an assembled view of the manual type card vending machine according to the present invention.

First, the structure of the manual type card vending machine according to the present invention referring to FIG. 1 is explained. Although the following discussion generally refers to the article dispensed from the vending machine as a card, it can be any card-like item.

The manual type card vending machine 1 according to the present invention is constructed with a vending machine main body 3, a transparent cover 5 which covers the front side of the vending machine main body 3 and extends to the sides, or side wings, of the vending machine main body 3, and a card information display 7 which is disposed between the transparent cover 5 and the vending machine main body 3. By fittingly disposing the transparent cover 5 on the vending machine main body 3, the card information display 7 is fixed along the sides from the front side of the vending machine main body.

On the front side of the vending machine main body 3, a coin insertion portion 9 is employed. This coin insertion portion 9 is formed elongated in the longitudinal direction and off-centered in the front portion of the vending machine main body 3. Further, in the coin insertion portion 9, disposed are a coin insertion slot 11 for inserting a coin and a return button 13 for returning of the inserted coin, and a coin return opening 15 for returning the coin.

On the front side of the vending machine main body 3 which is the bottom side of the coin insertion opening 9, a handle 17 is employed, and a card output opening 19 is employed on the left side of the handle 17. When purchasing a card, a card (merchandise) can be taken out from the output opening 19 by rotating the handle 17 after inserting a predetermined amount of coin or coins into the coin insertion opening 11.

The transparent cover 5 is removably installed on the front side of the vending machine main body 3. A ceiling board or cover 21 is installed on the ceiling portion of the manual type card vending machine 1, and it is locked in place by a back cover which in turn is also locked by a key or the like to prevent thefts and vandalism. One can unlock the back cover, slide the ceiling portion part way back and remove the display cover 5 by sliding it upard and outward. Of course, the transparent cover 5 can be constructed so that it is removed by itself without removing the ceiling board 21. Further, the transparent cover 5 has a flat portion **5*a* on its front and sloped portions 5*b* and 5*c*, or internal wings, which are sloped toward the coin insertion portion 9 from the flat portion 5*a*, and the tips of sloped portions 5*b*, 5*c* open where the coin insertion portion 9 is and form the open portion 5*d*. The sloped portions 5*b* and 5*c* and a connection portion therebetween form an arc around the coin insertion portion 9**.

Further, on the upper portion of the transparent cover 5, the upper frame **5*e* is formed, and a left frame 5*f* and a right frame 5*g*, or the side wings, are formed on both sides of the transparent cover 5. By inserting and sliding from the upper portion of the vending machine main body 3, the upper frame 5*e* of the transparent cover 5 will fit by the upper side of the vending machine main body 3, and the left and right frames 5*f*, 5*g* will be installed onto the sides of the vending machine main body 3**.

The transparent cover 5 employs a container portion which can contain the card information display 7 in its interior and around the front to the sides of the vending machine main body. In other words, the transparent cover 5 employs the upper frame **5*e*, the left and right side frames 5*f*, 5*g*, and the entire interior of the transparent cover 5 is employed as a container portion and is capable of containing the entire card information display 7. Accordingly, by installing the transparent cover 5 onto the vending machine main body 3, the card information display 7** can be fixed covering the front and around to the sides of the vending machine main body.

Further, not only is the portion which continues from the flat portion **5*a* of the transparent cover 5 to the upper portion frame 5*e*, and to the left side frame 5*f* and the right side frame 5*g* formed by bending in a short arc shape, but it is also formed in a round, circular shape. In that case, the card information display 7 is also bent in the shape of the transparent cover 5, and the entire card information display 7 is contained in the interior of the transparent cover 5**.

Figure 2:
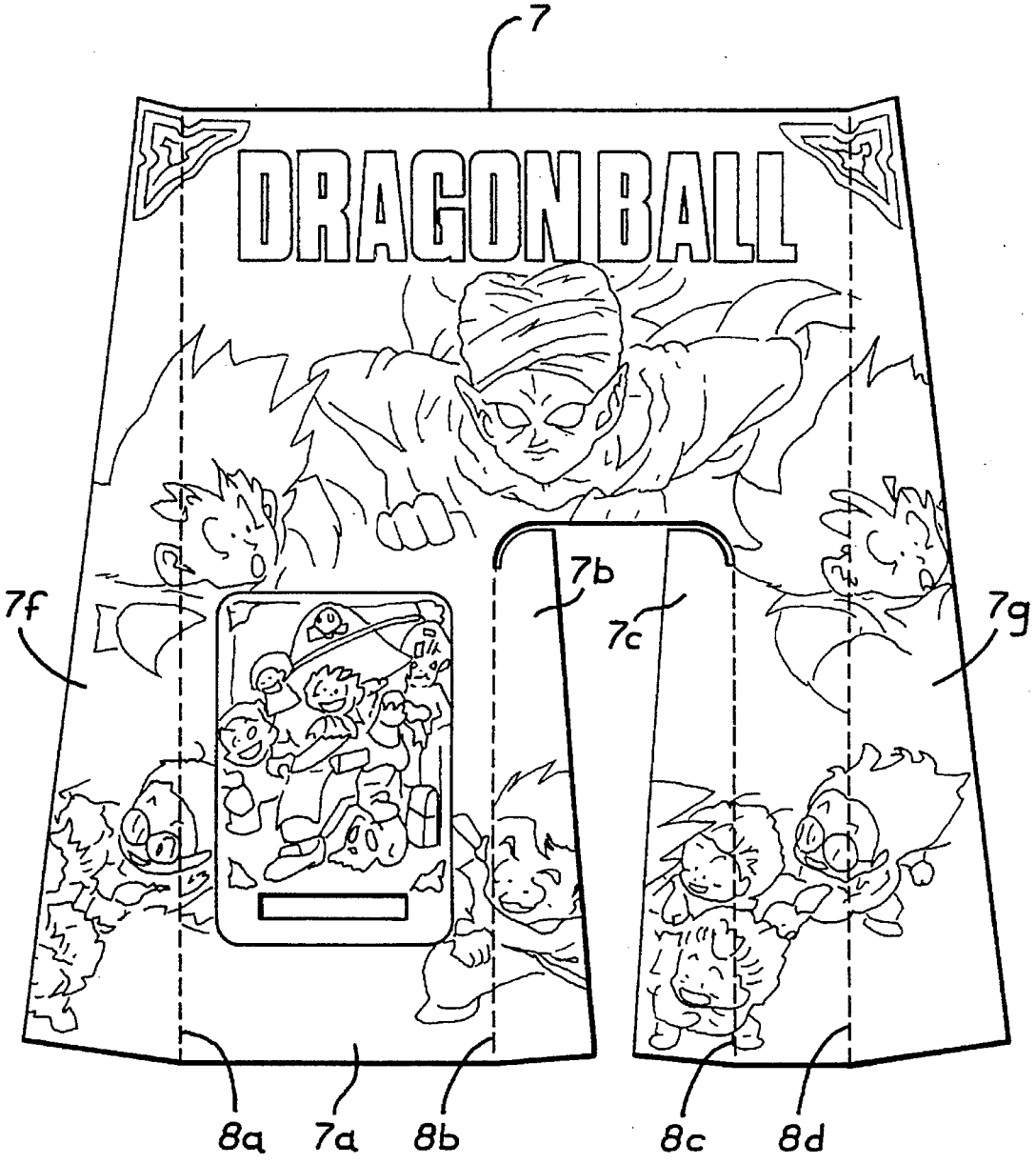
FIG. 2 shows a view of the open card information display.
Figure 3:
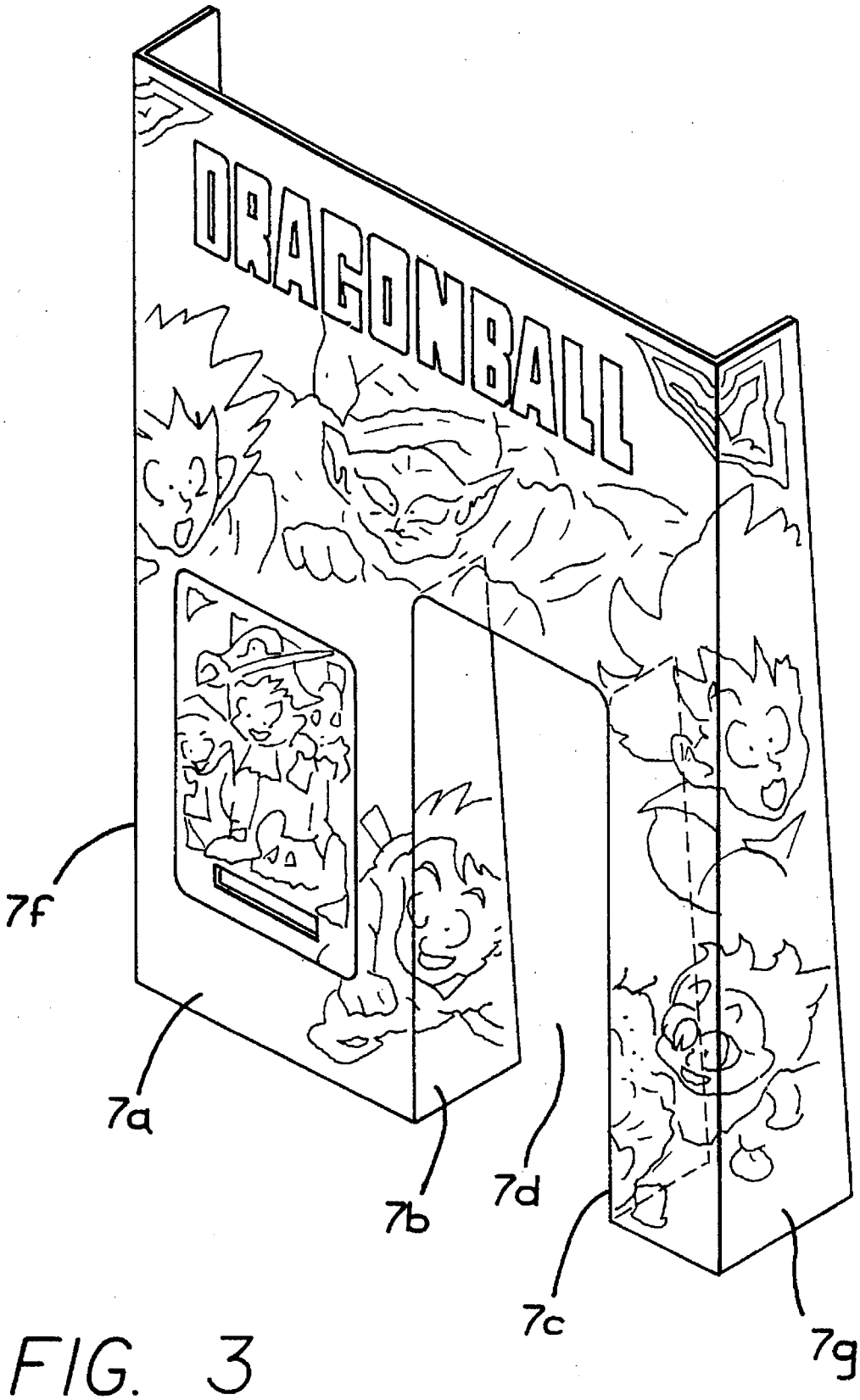
FIG. 3 shows an exterior view of the card information display.

Next, the card information display 7 is explained referring to FIGS. 2 and 3. As shown in FIG. 2 showing an opened view, the card information display 7 has characters and titles, etc. printed over its entire surface, which are information relating to the card. The card information display 7 has folding lines 8*a*, 8*b*, 8*c* and 8*d*, and by folding along these lines 8*a*, 8*b*, 8*c* and 8*d*, as shown in FIG. 3, it is formed into the same three-dimensional shape as that of the transparent cover 5. The surface of the card information display 7 is divided into areas 7*a*, 7*b*, 7*c*, 7*f* and 7*g* by the folding lines 8*a*, 8*b*, 8*c* and 8*d*, and the area 7*a* of the card information display 7 is contained in a position corresponding with a flat portion 5*a* of the transparent cover 5. Similarly, the sloped area 7*b*, 7*c* of the card information display 7, the internal wings, are contained in locations corresponding to the sloped sides 5*b* and 5*c* of the transparent cover 5, and the areas 7*f*, 7*g*, side wings, of the card information display 7 are contained in locations corresponding to the left side frame 5*f* and the right side frame 5*g* of the transparent cover 5. Further, the open portion 5*d* of the transparent cover 5 is set at a location corresponding to the open portion 7*d* of the card information display 7. Accordingly, as shown in FIG. 4, where the transparent cover 5 and the card information display 7 are installed on the vending machine main body 3, the coin insertion portion 9 is exposed through the opening portions 5*d*, 7*d*, and coins can be inserted into the coin insertion opening 11.

Figure 4:
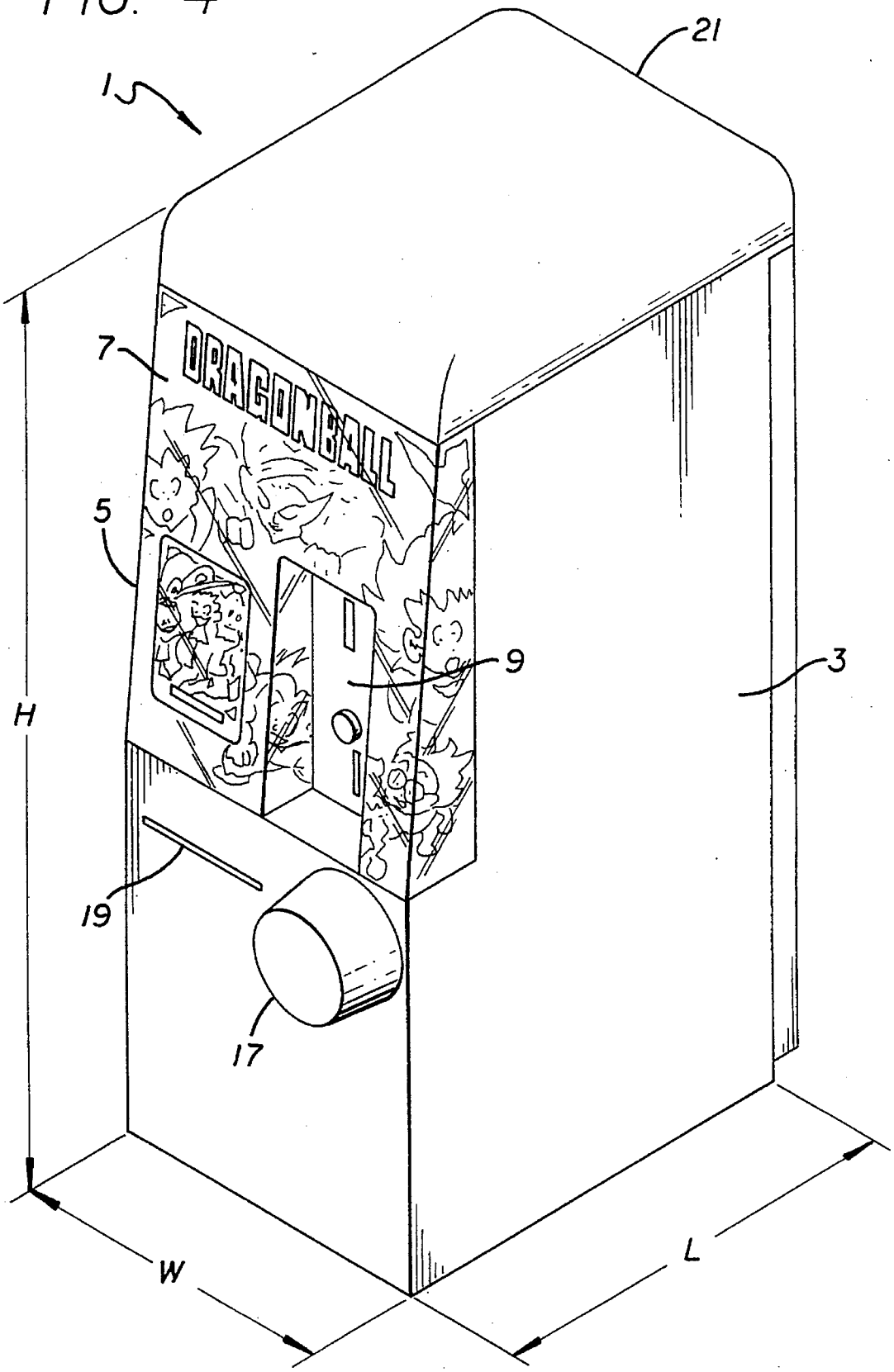
FIG. 4 shows an exterior view of the manual type card vending machine according to the present invention.

In FIG. 4, the card information display 7 is installed on the interior of the transparent cover 5, and it shows the exterior view where the transparent cover 5 is installed onto the vending machine main body 3.

The area 7*a* of the card information display 7 can be viewed through the flat portion 5*a* of the transparent cover 5, and similarly the sloped portions 5*b*, 5*c* of the transparent cover 5 lets a viewing of the sloped area 7*b*, 7*c* of the card information display 7, and the areas 7*f*, 7*g* of the card information display 7 can be viewed from the left and right side frames 5*f*, 5*g* of the transparent cover 5. Further, since the sloped area 7*b*, 7*c* of the card information 7 slope along the sloped portions 5*b*, 5*c* of the transparent cover 5, the sloped area 7*b*, 7*c* which can be viewed from the sloped portions 5*b*, 5*c* of the transparent cover 5 can be viewed with the area 7*a*, which is continuous from the areas 7*b*, 7*c*. Further, depending on the viewing angle, portions of the areas 7*f*, 7*g* of the card information display 7 which can be viewed from the left and right side frames 5*f*, 5*g* of the vending machine main body sides can be viewed along with the area 7*a* positioned in the front of the vending machine main body. Because of this, even if the main body 3 of the vending machine is down-sized, card information display area can be designed larger.

By removing the transparent cover 5 and changing the card information display 7, the content of the card information display 7 can be easily changed according to the types of cards.

The manual type card vending machine 1 according to the present invention is designed to be generally smaller in comparison to the prior art examples. For example, the width of the bottom surface is 174 mm; the depth is set at 233 mm; and the height is set at 450 mm. On the interior of the manual type card vending machine 1, various types of mechanical parts which are known are installed by unit methods. For instance, a coin sorting machine or a coin distinguishing mechanism is employed, which determines the type, amount, authenticity and other characterising of coins which are inserted from the coin insertion opening 11. Further, a coin return mechanism is employed to refund the inserted coin and to lead to the coin return opening 15 when the return button 13 is operated.

Further, a platform is employed where it corresponds to the position of the card output opening 19, and a plurality of cards are installed. These cards are made from appropriate materials such as plastic and have appropriate characters, etc. printed thereon. Further, a card advancing mechanism is employed which outputs only one card out of a plurality of cards from the card output opening 19 when the handle 17 is rotated once. In addition, employed are a lock mechanism to prevent the rotation of the handle 17 and an unlocking mechanism which unlocks the lock which is locked by the locking mechanism depending on the result of the distinction made by the coin distinguishing mechanism or sorter.

Usually, the locking mechanism locks the rotation of the handle 17 and prevents an improper card output. When coins are inserted from the coin insertion opening 11, the type and the number of coin or coins are determined by the coin sorting mechanism or the coin distinguishing mechanism, and upon determining that it is in the predetermined amount, the handle 17 is unlocked by the unlocking mechanism. In this way, only when the predetermined amount of coin or coins are inserted, the handle 17 can be rotated once and a card which was advanced by the card advancing mechanism can be taken out from the card output opening 19.

Figure 5:
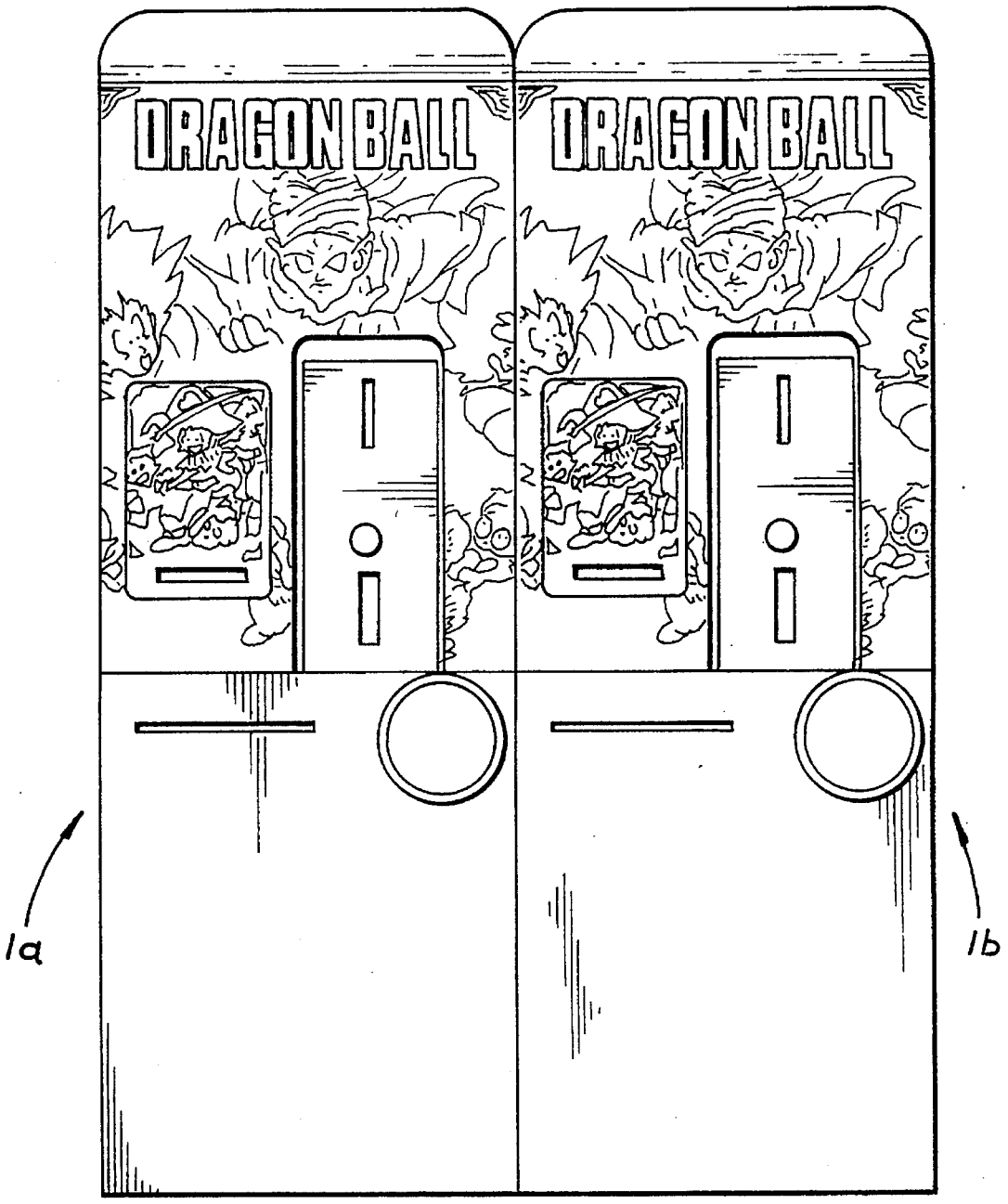
FIG. 5 shows a frontal view where two units of manual type card vending machines are set side by side.
Figure 6:
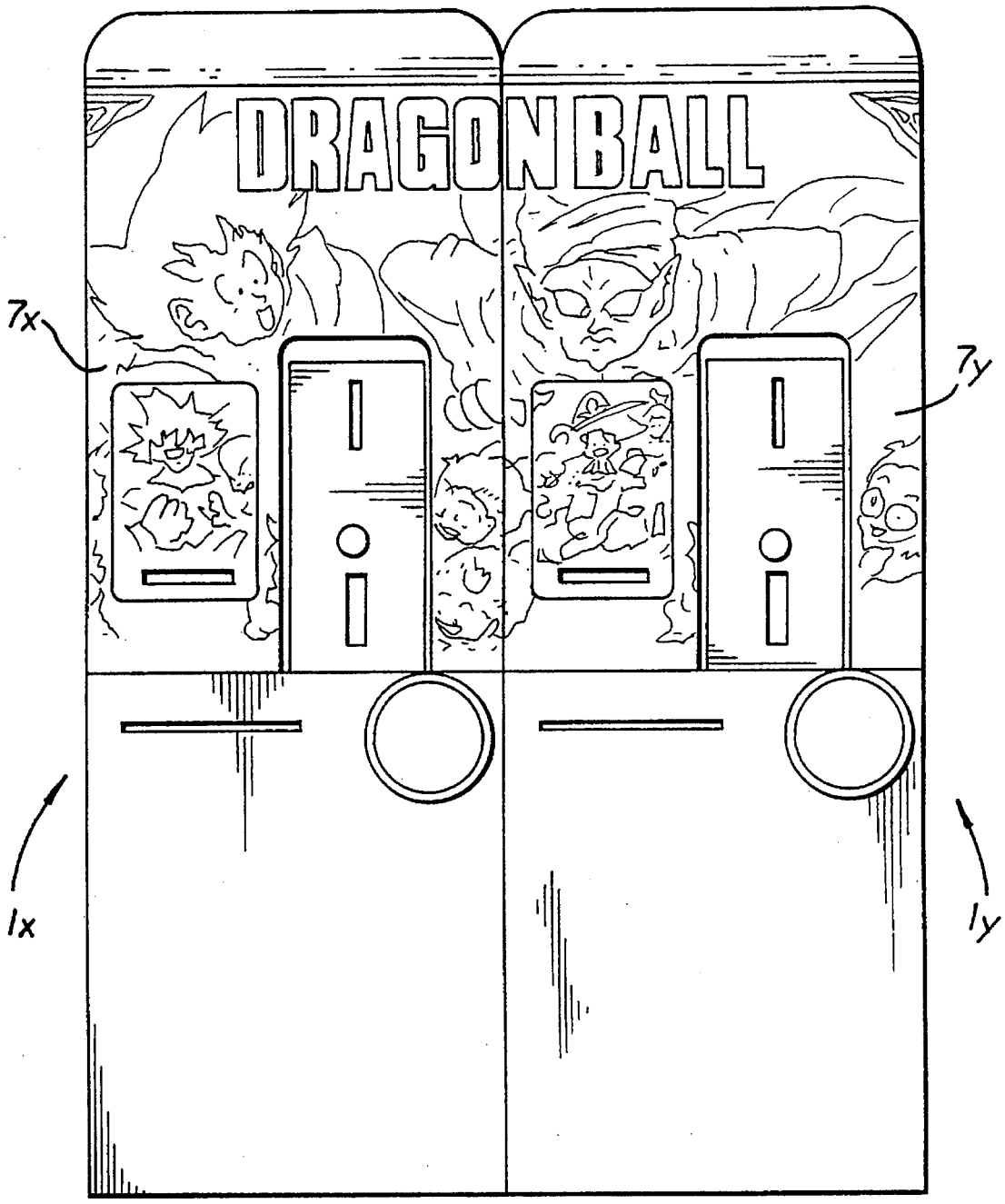
FIG. 6 shows a front view of two units of manual type card vending machines where their card information displays are designed to compose one display.

Next, effects of embodiments according to the present invention are explained in reference to FIGS. 4, 5 and 6. The manual type card vending machine 1 according to the present invention employs the transparent cover 5 which covers the front of the vending machine main body 3 and extends to the sides of the vending machine main body 3. Further, the transparent cover 5 employs a container portion which has the capacity of containing the card information display 7 in its interior from the front portion of the vending machine main body around to the sides of the vending machine main body. By removing the transparent cover 5, the card information display 7 can be changed so that depending on the type of cards, the content of the card information display 7 can be easily changed. Further, in the front of the vending machine main body 3, the coin insertion portion 9 can be set elongated in the longitudinal direction and off of its center, thereby avoiding a problem of splitting the central portion with the card information display 7, and even though the entire size of the manual type card vending machine 1 is designed smaller, the area for displaying card information can be designed larger.

Further, the front of the transparent cover 5 has the flat portion 5*a*, and the sloped portions 5*b*, 5*c* which are sloped toward the side of the coin insertion portion 9 from the flat portion 5*a*, and the edges of the sloped portions 5*b*, 5*c* open where the coin insertion 9 is and forms the opened portion 5*d*. The card information display 7 which is employed between the vending machine main body 3 and the transparent cover 5 is formed conforming to the shape of the transparent cover 5, and the slanted portions 5*b*, 5*c* of the transparent cover 5 can be viewed along with other portions so that the area for displaying card information can be designed larger. In other words, since the sloped areas 7*b*, 7*c* of the card information display 7 slope along the sloped portions 5*b*, 5*c* of the transparent cover 5, the sloped areas 7*b*, 7*c* which can be viewed from the sloped portions 5*b*, 5*c* of the transparent cover 5 can be viewed along with the area 7*a* which continue from them. Similarly, depending on the angle, areas 7*f*, 7*g* which can be viewed from the left and right side frames 5*f*, 5*g* of the transparent cover 5 can be viewed along with the area 7*a* located in the front. Accordingly, despite the fact that the entire size of the manual type card vending machine 1 is designed to be smaller, the viewable area for card information display can be designed larger.

As stated above, even where the vending machine main body 3 has been down sized, the card information display area for display portion relating to the card information can be designed larger, thereby enabling effective advertisement utilizing the front of the manual type card vending machine 1.

Since the handle 17 is employed on the front of the vending machine main body 3 for taking out a card after inserting coins in the coin insertion opening 11, as shown in FIG. 5, two units of the manual type card vending machines 1*a*, 1*b* can be set side by side very closely, thereby downsizing the installation area. Further, in addition to above, since the size of the manual type card vending machine 1 has been made smaller, three units of the manual type card vending machines 1 according to the present invention can be set in an area designed for 2 units of prior art manual type card vending machines.

Further, as shown in FIG. 6, when setting up two units of manual type card vending machines 1*x*, 1*y*, if the card information display 7*x* of the manual type card vending machine 1*x* and the card information display 7*y* of the manual type card vending machine 1*y* are made so that they make one continuous picture, then a large and high impact character can be displayed and a great impact can be made to stimulate a potential buyer's desire to purchase.

Cards sold by the manual type card vending machine according to the present invention can display information relating to appropriate games such as Janken (a game of "scissors-paper-rock"), etc. or bar code in addition to various pictures and characters, and these various types of cards are sold as merchandise.

Further, two units of manual type card vending machines where they are set side by side have been explained in FIGS. 5 and 6, but three units of manual type card vending machines set side by side similarly enables setting in a various close condition, thereby downsizing the installation area.

Furthermore, where more than three units of manual type card vending machines are set side by side, if these plurality of card information displays are designed to comprise one continuous picture, a character can be displayed in a much louder and larger display and can offer a larger impact to stimulate purchase desire.

Further features and advantages of the present invention will be appreciated by those skilled in the art. Additionally, those skilled in the art will appreciate that a wide variety of modifications may be made in the specific embodiment described above, and that such embodiment is purely for illustrative purposes. Accordingly, the scope of the present invention should be viewed as commensurate with the following claims.

What is claimed is:

1. A pair of vending machines for selling cards, each comprising:

a vending machine body defining a coin slot for accepting a coin, the coin slot located off-center of the front of the vending machine body;

a display cover substantially covering the top portion of the front of the vending machine body and having side wings and internal wings, the internal wings defining a coin slot opening for the coin slot;

a display having display side wings and display internal wings, the display cover fitting over the display; and a handle for outputting the card disposed on the front of the vending machine body, wherein the displays of the pair of vending machines are such that two displays compose one continuous picture when the pair of vending machines are set side by side.

2. A pair of vending machines as claimed in claim 1, wherein the handle is rotatable.

3. A pair of vending machines as claimed in claim 1, wherein the size of each vending machine is substantially 174 mm wide at the bottom, 233 mm deep and 450 mm tall.

4. A pair of vending machines as claimed in claim 1, wherein each vending machine further comprises a storage for storing cards, disposed in the vending machine body.

5. A pair of vending machines as claimed in claim 1, wherein each vending machine further comprises a ceiling cover slidably disposed on top of the vending machine body.

6. The vending machines as claimed in claim 1, each vending machine further comprising a coin refund mechanism disposed in the coin slot opening.

7. A pair of vending machines as claimed in claim 1, wherein each vending machine further comprises a display slidably disposed in the display cover.

8. A pair of vending machines as claimed in claim 7, wherein the display depicts an advertisement of the card.

* * * * *